US005232282A

United States Patent [19]

Johnson

[11] Patent Number: 5,232,282

[45] Date of Patent: Aug. 3, 1993

[54] FOOD WASTE MIXING AND HEAT TREATING VEHICLE, HOG LOT AND METHOD OF RAISING AND FEEDING HOGS

[76] Inventor: Daniel E. Johnson, 309 - 202nd NW., . Cedar, Minn. 55011

[21] Appl. No.: 910,736

[22] Filed: Jul. 8, 1992

[51] Int. Cl.[5] ..... B01F 15/06

[52] U.S. Cl. ..... 366/147; 99/348; 366/40; 366/44

[58] Field of Search ..... 366/147, 4, 5, 7, 40, 366/54, 57, 59, 44; 99/348

[56] References Cited

U.S. PATENT DOCUMENTS

| | | | |
|---|---|---|---|
| 2,029,126 | 1/1936 | Rybeck | 366/59 |
| 2,537,585 | 1/1951 | Hilkemeier | 366/40 |
| 5,056,924 | 10/1991 | Christenson | 366/59 |

*Primary Examiner*—Robert W. Jenkins
*Attorney, Agent, or Firm*—Palmatier, Sjoquist and Helget

[57] ABSTRACT

A food waste mixing and heat treating vehicle used in feeding hogs has a wheeled chassis. A mixing drum is rotatably mounted on the chassis having an inner wall forming a mixing and heating cavity and having an opening into the cavity. Means are provided for rotating the mixing drum. Two opposing helical mixing blades are each affixed along the inner wall from the opening into the cavity for drawing the food waste into the cavity from the opening, mixing the food waste in the cavity and evacuating the food waste out of the cavity through the opening. Steam injecting means are along the inner wall within the cavity for injecting steam through the food waste for heat treating the food waste for later feeding hogs after the food waste has cooled. The method involves the collecting, heat treating and feeding of the food waste to hogs with the vehicle. The hog lot for raising and feeding hogs the heat treated food waste comprises a plurality of adjacent elongate pens with a juxtaposed feed pen there along. The feed pen is easily accessible by the vehicle.

16 Claims, 3 Drawing Sheets

FOOD WASTE MIXING AND HEAT TREATING VEHICLE, HOG LOT AND METHOD OF RAISING AND FEEDING HOGS

BACKGROUND OF THE INVENTION

This invention relates generally to the feeding and raising of hogs or swine, and more particularly to a food waste mixing and heat treating vehicle, method of feeding and raising hogs, and a hog lot therefor.

Hog, swing or pork is an important livestock to the agricultural industry. Hogs or pigs are typically born in a farrowing house where they remain with their mothers for approximately one month or until they reach approximately 50 pounds. Thereafter, the young hogs are placed in a lot or pen where they will remain for the duration of their life span which is approximately 6 to 8 months or until they reach approximately 230 pounds. Thereafter, the hogs are transported to the market.

The raising and feeding of hogs is regulated by the Animal and Plant Health Inspection Service and Veterinary Service Divisions of the U. S. Department of Agriculture. The primary reason for the regulation is for the avoidance and prevention of animals diseases. Animal diseases that may infect hogs or swine include trichinosis, African swine fever, vesicular exanthema, hog cholera, tuberculosis, swine erysipelas, foot-and-mouth disease, swine vesicular disease and salmonellosis. Some of these diseases are easily spread throughout the animal population and also may be contracted by humans by eating raw or undercooked infected pork.

Hogs have traditionally been fed and raised on waste food garbage or upon feed typically comprised of various grains. Feeding swine feed or grains proposes little problems to the farmers in the spreading of diseases provided the animal population is watched for good health and the spreading of diseases by other means. However, many farmers who feed their swine grains or feed supplement the product with vitamins and hormones to increase the animals mass and accelerate the growth cycle. Conscientious pork eating consumers, however, dislike any form of additives and prefer that the animals be raised naturally without additives.

The feeding of waste food or garbage to hogs has long been known but has presented special problems in animal disease prevention. Natural food or uncooked garbage is typically collected from the remaining food from tables in restaurants and elsewhere. After meat and food scraps have had opportunity to sit in the garbage without any form care, disease-producing agents begin to appear. When the infected food waste is eaten by swine, the introduction and spreading of diseases begin to occur. Furthermore, uncooked garbage is unpalatable even to swine or hogs.

Consequently, the garbage or waste food, under federal regulation, must be heat treated. That is, the waste food must be brought to approximately 180° and remain thereat for 30 to 60 minutes after which it is permitted to cool and then fed to the hogs. Heat treating the garbage is important in that it eradicates diseases and disease-producing agents. The heat treated garbage appears as a porridge or booya which is easily fed to the swine leaving less residue and decomposition. Consequently, the remaining or unconsumed heat treated garbage is easily cleaned involving less labor and thereby attracting fewer flies and producing less objectionable odor. The heat treating of the food waste evenly distributes the food value thereby making a more uniform feed which is excellent for small pigs which are otherwise moved aside by the larger hogs.

There are generally two known ways to heat treat food waste or garbage. One method is the direct fire method. Small amounts of the waste food in the range of no greater than 300 gallons is collected in a vat and heated by flames in direct contact with the vat. The direct fire method has its drawbacks in that the food waste requires stirring to avoid burning of the garbage on the inside bottom of the vat. Also, the garbage has a tendency to dry out. For these reasons, only small loads of garbage can be treated in direct fire equipment.

A second method of heating treating garbage or food waste involves the introduction or injection of steam into the bottom of the load of garbage or food waste. Steam is advantageous because it adds water to the waste food. Box trucks have been used wherein steam pipes are fastened along the flat bottom of the truck body or vat perhaps 14 inches apart. However, such units are susceptible to "cold areas" between the pipes which does not properly cook the food waste. Furthermore, such trucks or units typically have a leakage problem, heat the garbage unevenly, are difficult to unload and have gaskets or seals which are easily ruined by the hot cooking greases contained within the garbage.

There is a need for a food waste mixing and heat treating vehicle that has the advantages of providing steam injection into the load, heats evenly, unloads easily, is extremely durable and heat treats large loads of food waste in the range of 60,000 pounds.

SUMMARY OF THE INVENTION

A food waste mixing and heat treating vehicle used in feeding hogs has a wheeled chassis. A mixing drum is rotatably mounted on the chassis having an inner wall forming a mixing and heating cavity and having an opening into the cavity. Means are provided for rotating the mixing drum. Two opposing helical mixing blades are each affixed along the inner wall from the opening into the cavity for drawing the food waste into the cavity from the opening, mixing the food waste in the cavity and evacuating the food waste out of the cavity through the opening. Stem injecting means are along the inner wall within the cavity for injecting steam through the food waste for heat treating the food waste for later feeding hogs after the food waste has cooled. The method involves the collecting, heat treating and feeding of the food waste to hogs with the vehicle. The hog lot for raising and feeding hogs the heat treated food waste comprises a plurality of adjacent elongate pens with a juxtaposed feed pen there along. The feed pen is easily accessible by the vehicle.

A principal object and advantage of the present invention is that the food waste mixing and heating treating vehicle provides the means for steam injection treatment of food waste in quantities as large as 60,000 pounds or 9 cubic feet which will easily facilitate the feeding of approximately 1,000 hogs per day.

Another object and advantage of the present invention is that the mixing drum with this helical mixing blades provides a excellent means of mixing the food waste before and after heat treatment for distributing food value and producing a more uniform palatable feed.

Another object and advantage of the present invention is that the vehicle of the present invention provides for easy loading of the food waste with even more easy unloading of the heat treated garbage resulting in directly evacuating the mixed and heat treated food waste to exactly where the hogs are to be fed.

Another object and advantage of the present invention is that the mixing drum with the steam injecting means provides for even heating of the food waste with the absence of cold areas due to its unique drum-like structure.

Another object and advantage of the present invention is the vehicle and mixing drum and components thereof is of a metallic construction rendering itself extremely durable and capable of handling large capacities of food waste without being ruined by hot cooking greases.

Other objects and advantages of the present invention will become apparent upon a review of the following specification, appended claims and figures herein.

DETAILED SPECIFICATION

Figure 1:
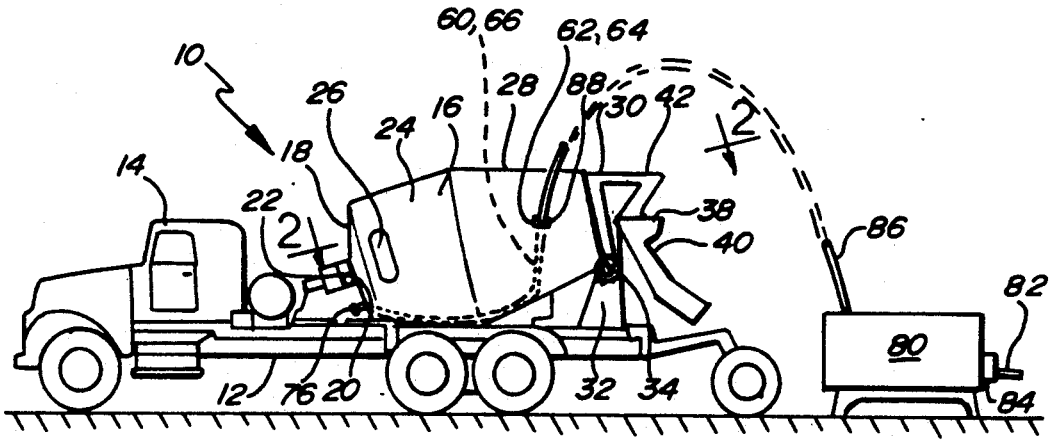
FIG. 1 is a side elevational view of the food waste mixing and heat treating vehicle of the present invention showing the steam injecting source in the mixing drum and a nearby boiler.
Figure 2:
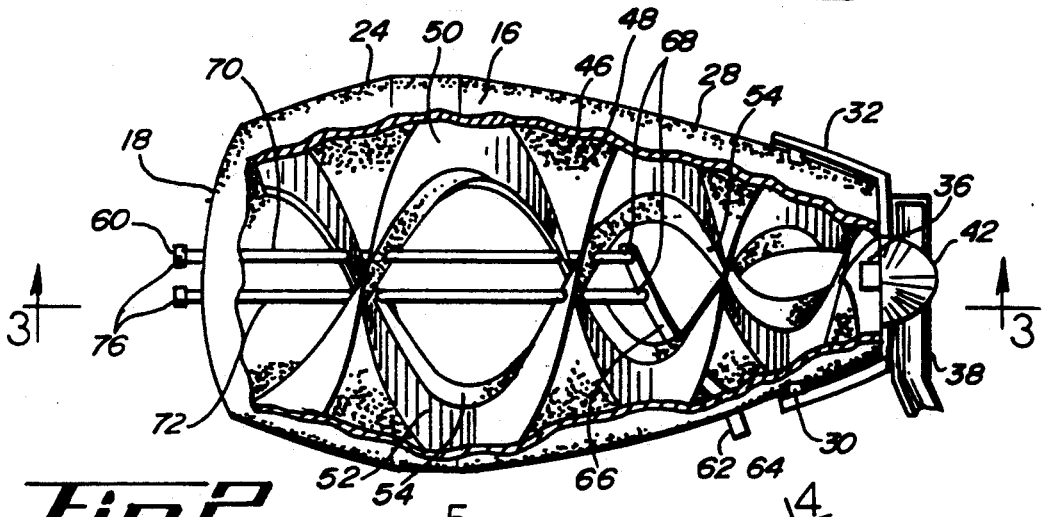
FIG. 2 is a cross-sectional plan view of the mixing drum taken along lines 2—2 of FIG. 1 showing the cavity of the mixing drum.
Figure 3:
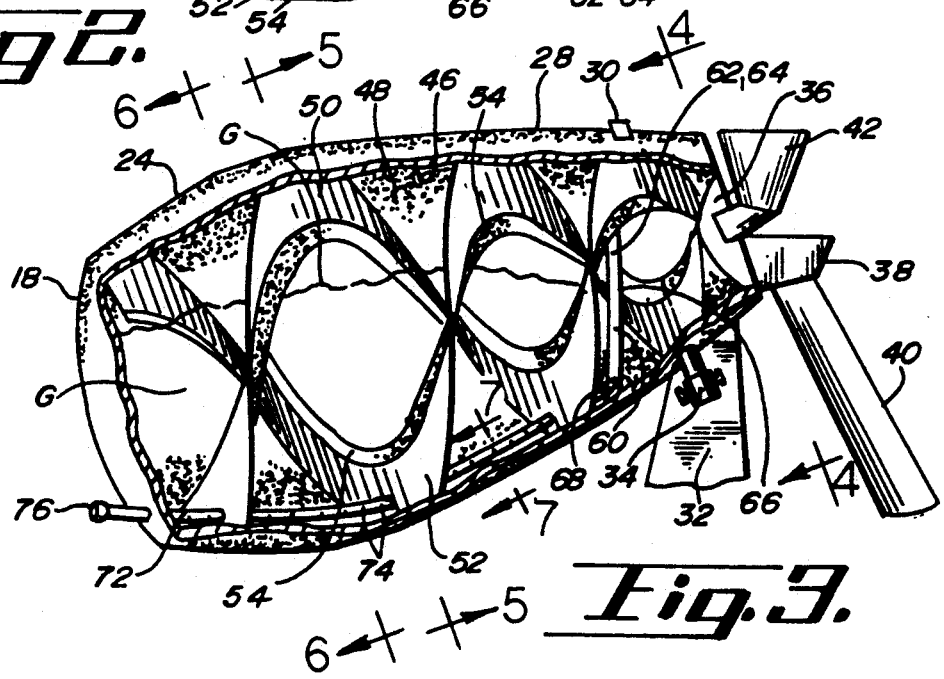
FIG. 3 is a cross-sectional side elevational view taken along arcuate lines 3—3 of FIG. 2.
Figure 4:
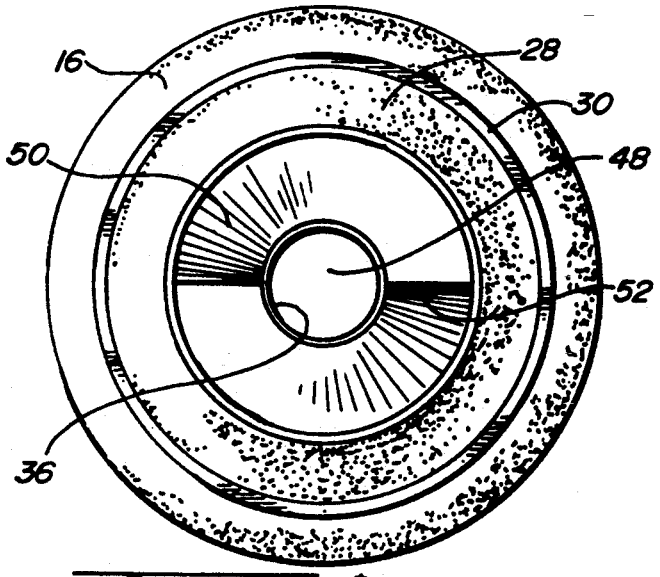
FIG. 4 is an end view of the mixing drum taken along lines 4—4 of FIG. 3.
Figure 5:
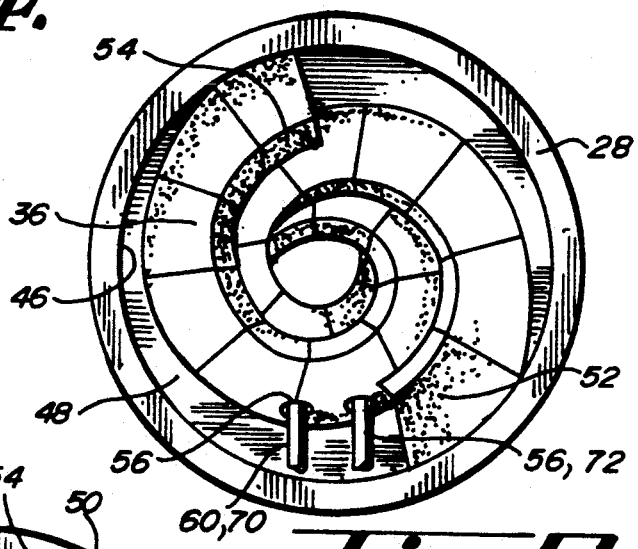
FIG. 5 is a cross-sectional view taken along lines 5—5 of FIG. 3 showing the mixing drum.
Figure 6:
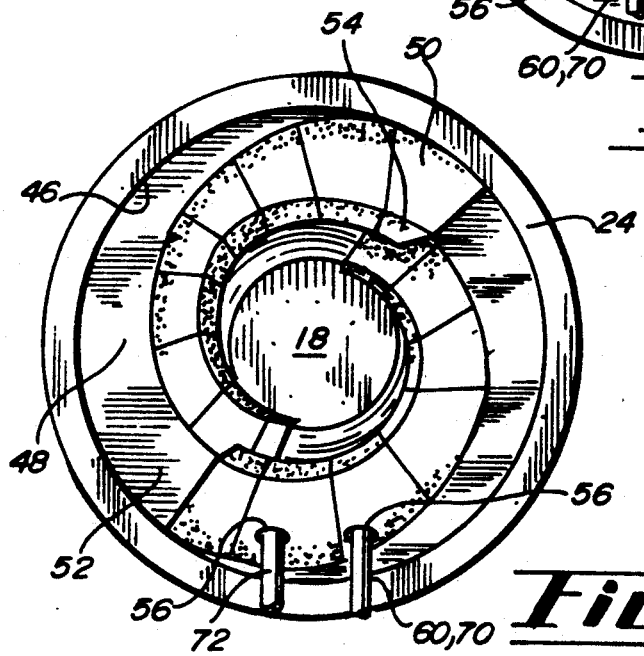
FIG. 6 is a cross-sectional view taken along lines 6—6 of FIG. 3 showing the cavity of the mixing drum.

The food waste mixing and heat treating vehicle 10 may generally be seen in FIG. 1 with detailed sectional views of the interior of the mixing drum 16 clearly shown in FIGS. 2 through 7. Mixing trucks commonly used for the delivery of cement are known. One such company operates under the trademark MTM ® and is known McNelius Truck and Manufacturing, Inc. of Dodge Center, Minn. 55927. Applicant has taken a cement mixing truck or vehicle and modified and reconfigured the vehicle into a food waste mixing and heat treating vehicle 10 which is one aspect of the present invention.

The vehicle or truck 10 generally includes a wheeled chassis 12 which suitably is self-propelled and has cab 14 for the driver. The self-propelled wheeled chassis 12 supports a mixing drum 16 made of steel approximately ¼ to 3/16's of an inch thick. The drum 16 has a drum head 18 pointed toward the cab 14 which supports an extending spindle 20 which interlocks with a rotating drive means or mechanism 22 which may either be direct gear hydraulic or a hydraulic sprocket and chain configuration for rotating the mixing drum 16.

The mixing drum 16 has an intermediate section 24 with an inspection hatch 26 therein. The tail cone section 28 generally protrudes upwardly and rearwardly and has a rearwardly located roller track there around. A drum support 32 extends upwardly and is part of the chassis 12 which has a bearing assembly 34 which suitably rides along the roller track 30 and supports the rotating drum 16. Most rearwardly is a tail cone section opening 36 below which is located a main shoot 38. From main shoot 38 an extension shoot 40 may selectively pivotally extend with 180° rotation from the rear of the chassis 12. Leading into opening 36 is a loading funnel 42.

The interior of the mixing drum 16 is clearly seen in FIGS. 2 through 7. Inner wall 46 forms the boundary for the mixing and heating cavity 48 of the mixing drum 16. Commercially available drums 16 appropriately have a cavity capable of holding 9 cubic yards or approximately 60,000 pounds of raw food waste G. Along the inner wall 46 are two opposing helical mixing blades 50 and 52 suitably affixed to wall 46 as by welding. The mixing blades 50 and 52 appropriately may have a thickness of 3/6 of an inch and are made out of steel as to resist wear. The blades 50 and 52 may have elongate fins 54 which assist in drawing material in the cavity 48 as well as extracting materials from the cavity 48 through opening 36.

As seen in FIGS. 2 through 7, aligned holes 56 are appropriately punched out, cut out or burned out of mixing blades 50 and 52 approximately 4 inches from the inner wall 46. Another hole or aperture (not shown) is punched through the wall of the tail cone section 28. Thereafter, the steam injector means 60 is ready to install in the mixing drum 16.

The steam injector means 60 generally comprises a steam manifold inlet 62 on the outside of the mixing drum 16. A steam manifold 66 approximately 2 inches in diameter extends through the aperture of the tail cone section 28 of the mixing drum 16 and is suitably welded thereat. The manifold 66 further extends along the inner wall 46 as to be alignable along the bottom of inner wall 46 with rotation of the drum 16. Manifold 66 suitably may then have two unions 68 from which lateral steam injecting pipes 70 and 72 extend substantially along the bottom of inner wall 46 approximately 4 inches off the bottom of the inner wall 46. Steam manifold 66 and the lateral steam injecting pipes 70 and 72 appropriately may be welded in place at the inner wall 46 for manifold 66 and at mixing blades 50 and 52 as the ejecting pipes 70 and 72 pass through holes or apertures 56. It is appropriate that steam injection pipes 70 and 72 may be approximately 18 inches apart and 1½ inches in diameter. Located along the injection pipes 70 and 72 appropriately are located apertures 74 which are suitably ⅛ inches in diameter and approximately 1 inch apart. The apertures 74 are suitably directed downwardly and outwardly as clearly in shown in FIG. 7. The steam injection pipes 70 and 72 extend substantially along the greater portion of mixing drum 16 and extend out through the drum head 18 and terminate in blow off or bleeder valves 76.

As seen in FIG. 1, a boiler 80 schematically is shown and suitably may be one million BTU's in size capable of producing 7 to 10 pounds per square inch of steam during the course of the heat treatment process. Boiler 80 has a water feed inlet 82 connected to a pump 84. On the exit side of boiler 80 is a flexible hose steam line 86 appropriately having a coupler 88 which will cooperatively and releasably interlock with coupling 64 located at the manifold inlet 62.

The operation and method of feeding and raising hogs will now be appreciated. Initially, waste food or garbage is collected such as from that disposed from restaurants or the like. The collected waste food is then dumped into the loading funnel 42 of the vehicle 10 while the mixing drum 16 is rotated clockwise as to draw the food waste G into the mixing and heating cavity 48. The action of the mixing blades 50 and 52 together with their fins 54 will mix the food waste G. For clarity of the invention, the food waste is not illustrated in all figures as to not obscure the important structural features of this invention. The vehicle 10 together with its mixing drum 16 appropriately should handle approximately 60,000 pounds of food waste to be loaded into cavity 48 through opening 36 with the assistance of funnel 42.

After loading and thorough mixing, the vehicle 10 is then located adjacent boiler 80. The drum rotaton is stopped with pipes 70 and 72 located on the bottom of cavity 48. The flexible hose steam line 86 with its coupler 88 is connected to coupling 64 of the steam manifold inlet 62. Thereafter, the boiler is fired up and water is permitted to be converted into steam at a rate of 7 to 10 pounds per square inch. Bleeder valves are opened momentarily to clear and clean the steam injector means 60. After approximately one hour, the food waste within the cavity 48 should attain a temperature of 180° F. This time may vary with the ambient temperature. It is recommended to hold this temperature of the food waste for approximately one hour as to thoroughly eradicate any disease agents contained within the garbage and to completely cook the food waste. The unique barrel design of the mixing drum 16 will assure even mixing of the steam as it is ejected from injection pipes 70 and 72 clearly shown by arrows in FIG. 7. Thereafter, the boiler 80 may be turned off and disconnected from the vehicle 10 in reverse order. The load is then permitted to cool. Hogs or swine should not be served the heat treated food waste until the temperature of the waste has fallen below 100° F. as to not burn the stomach of the animals.

Figure 8:
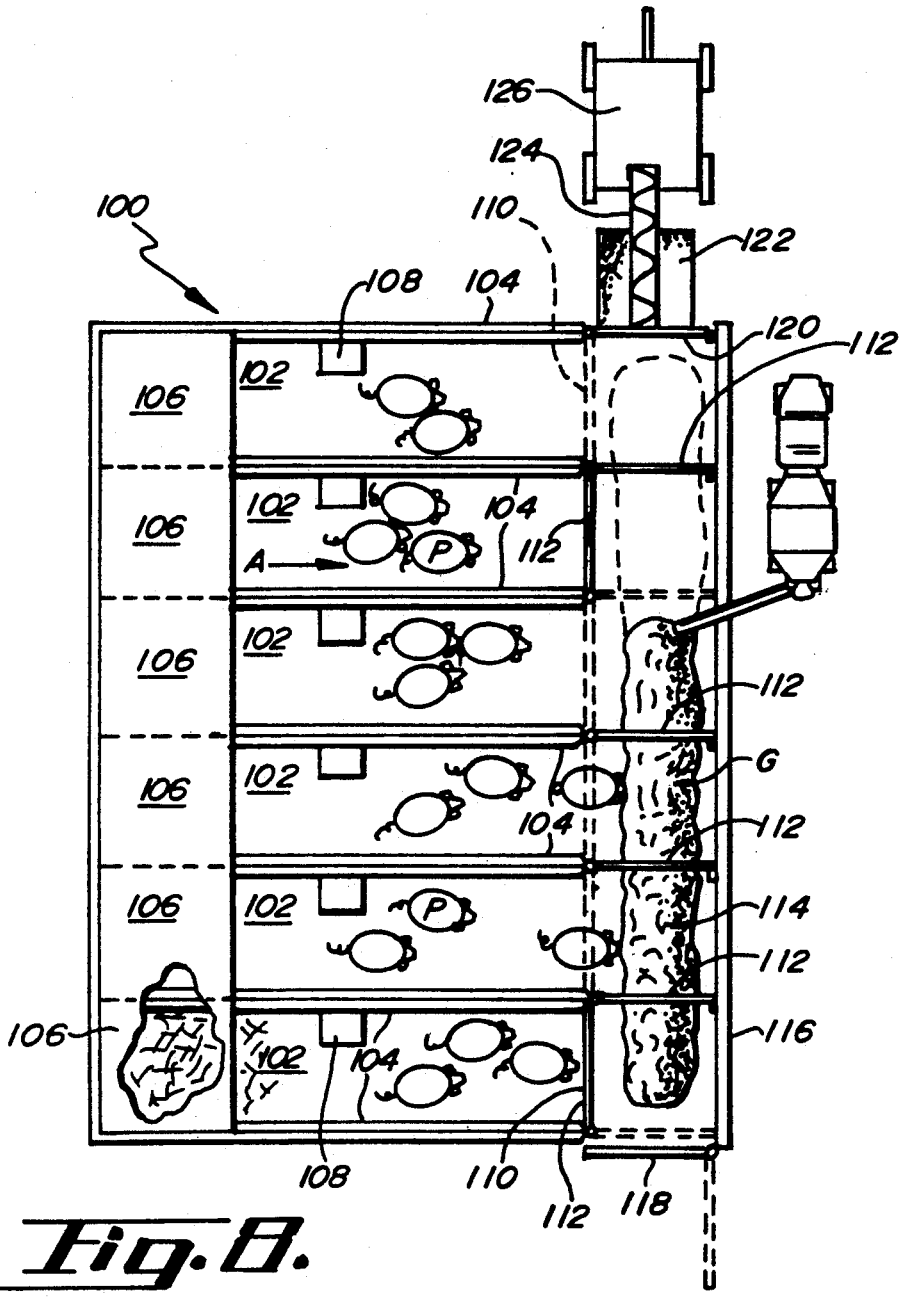
FIG. 8 is a plan view of the hog raising and feeding lot.
Figure 7:
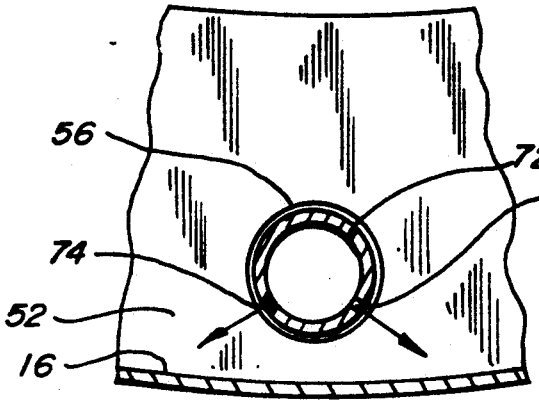
FIG. 7 is a cross-sectional view of the steam injecting pipes along the inner wall of the mixing drum taken along lines 7—7 of FIG. 3.

After the food waste that has been heat treated has cooled, the mixing drum 16 again may be rotated by the drive mechanism 22 and the vehicle 10 may approach the hog lot 100 as shown in FIG. 8.

Hog lot 100 suitably has adjacent elongate pens 102 which are separated by walls each with a fence 104 thereon approximately four feet high. The elongate pens 102 suitably have a cement floor and are 48 feet by 16 feet in recommended dimension. The pens appropriately slope in the direction of arrow A. At one end of each elongate pen 102 is located a covered sleeping end 106 which suitably may have a roof and a hay bed thereunder approximately 20 feet by 16 feet in dimension and adjoining the elongate pen 102. A fresh water source 108 should be located within each pen 102. Each elongate and adjacent pen 102 has a gate end 110 which is approximately 16 feet there across at which gates 112 are located. Along the gate end 110 is located a juxtaposed feed pen 114 which suitably has a cement floor and is approximately 100 feet long and 16 feet wide bound by a wall 116 which is appropriately 4 feet high. One end of the feed pen 114 appropriately has an access gate 118 which is approximately 16 feet across. Opposing the access gate 118 is suitably cleaning gate 120 which is also perhaps 16 feet across. On the other side of cleaning gate 120 is located a pit 122 which illustratively may be 4 by 4 feet. Within the pit 122 is a cleaning auger 124 which will collect the waste scraped or pushed into the pit including all fluids which will then be loaded into a wheeled spreader 126 and disposed of by spreading over a field as fertilizer.

As the food waste mixing and heat treating vehicle 10 approaches the hog lot 100, the mixing drum 16 is rotated. The truck is aligned along the outer wall 116 of the feed pen 114 and the extension shoot 40 of the vehicle 10 is positioned centrally within the feed pen 114 as it spans over the wall 116. Next, the mixing drum 16 is rotated in a counter clockwise manner by drive mechanism 22 as to draw the heat treated food waste G upwardly and into the main shoot 38 from which it spills down as in a porridge form into extension shoot 40 and into the central area of feed pen 114. The vehicle 10 is then moved along the feed pen as the treated food waste G is dumped into the feed pen 114.

If the heat treated food waste necessitates additional cooling, it may be allowed to sit for a while. Thereafter, the variously sizes hogs within elongate pens 102 may selectively be allowed to approach the heat treated food waste within the feed pen 114 by the opening of gates 112. Gates 112 will the span across the width of the feed pen 114 as to prevent the differently sizes pigs P from commingling to assure that smaller pigs get adequate feeding.

After the pigs have been permitted to feed, they are then moved back into their elongate pens 102 and gates 112 are closed. Thereafter, the feed pen 114 may be scraped or cleaned as with a front end loader or bobcat. The elongate pens 102 are sloping the direction of the feed pen 114 as to make the pens 102 self cleaning. That is, the hogs will drag waste, debris and whatnot toward the direction of the feed pen 114 for cleaning. This action is further assisted by the action of rain. As the feed pen 114 is cleaned and the waste is collected within pit 122, the cleaning auger 124 loads the spreader 126 for distribution of the refuge into a field as fertilizer.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. Food waste mixing and heat-treating vehicle used in feeding hogs, comprising:

(a) a wheeled chassis;

(b) a mixing drum rotatably mounted on the chassis, the drum having an inner wall forming a mixing and heating cavity and an opening into the cavity;

(c) means for rotating the mixing drum;

(d) two opposing helical mixing blades each affixed along the inner wall from the opening into the cavity for drawing the food waste into the cavity from the opening, mixing the food waste int he cavity and evacuating the food waste out of the cavity through the opening; and (e) means through the drum and along the inner wall for injecting steam into the cavity and through the food waste for heat-treating the food waste for later feeding hogs after the food waste has cooled comprising a steam manifold which passes through the drum into the cavity along the inner wall and a steam ejecting pipe extending from the manifold, through the blades along the inner wall.

2. The vehicle of claim 1 wherein the steam ejecting pipe extends through the drum and terminates in a blow-off bleeder valve for exhausting steam through the manifold and the pipe for cleaning purposes.

3. The vehicle of claim 1 wherein the steam ejecting pipe runs along but does not contact the inner wall at least one half of the length of the mixing drum.

4. The vehicle of claim 1 wherein there are two steam ejecting pipes extending substantially parallel from the manifold.

5. The vehicle of claim 1 wherein the steam ejecting pipes have apertures therein to permit steam to flow therethrough.

6. The vehicle of claim 1 wherein the steam manifold on the outside of the mixing drum is adapted for releasable connection to a steam generating source.

7. The vehicle of claim 1 further comprising a chute mounted on the chassis below the opening for directively evacuating the mixed and heat-treated food waste from the cavity out of the mixing drum through the opening to where the hogs are to be fed.

8. The vehicle of claim 1 further comprising a loading funnel extending into the opening to assist in loading the food waste into the cavity.

9. Food waste mixing and heat-treating vehicle used in feeding hogs, comprising:

(a) a wheeled chassis;

(b) a mixing drum rotatably mounted on the chassis, the drum having an inner wall forming a mixing and heating cavity and an opening into the cavity;

(c) means for rotating the mixing drum;

(d) two opposing helical mixing blades each affixed along the inner wall from the opening into the cavity for drawing the food waste into the cavity from the opening, mixing the food waste in the cavity and evacuating the food waste out of the cavity through the opening; and (e) means through the drum and along the inner wall for injecting steam into the cavity and through the food waste for heat-treating the food waste for later feeding hogs after the food waste has cooled, comprising a steam manifold which passes through the drum into the cavity along the inner wall and a steam ejecting pipe with apertures therein extending from the manifold through the blades along the inner wall.

10. The vehicle of claim 9 wherein the steam ejecting pipe extends through the drum and terminates in a blow-off bleeder valve for exhausting steam through the manifold and the pipe for cleaning purposes.

11. The vehicle of claim 9 wherein the steam ejecting pipe runs along but does not contact the inner wall at least one-half the length of the mixing drum.

12. The vehicle of claim 9 wherein there are two steam ejecting pipes extending substantially parallel from the manifold.

13. The vehicle of claim 9 wherein the steam ejecting pipes have apertured therein to permit steam to flow therethrough.

14. The vehicle of claim 9 wherein the steam manifold on the outside of the mixing drum is adapted for releasable connection to a steam generating source.

15. The vehicle of claim 9 further comprising a chute mounted on the chassis below the opening for directively evacuating the mixed and heat-treating food waste from the cavity out of the mixing drum through the opening to where the hogs are to be fed.

16. The vehicle of claim 9 further comprising a loading funnel extending into the opening to assist in loading the food waste into the cavity.

* * * * *